US007907096B2

(12) United States Patent
Timofeev et al.

(10) Patent No.: US 7,907,096 B2
(45) Date of Patent: Mar. 15, 2011

(54) PHASE SHIFTER AND ANTENNA INCLUDING PHASE SHIFTER

(75) Inventors: Igor E. Timofeev, Dallas, TX (US); Martin L. Zimmerman, Chicago, IL (US); Ai Xiangyang, Murphy, TX (US)

(73) Assignee: Andrew LLC, Hickory, NC (US)

( * ) Notice: Subject to any disclaimer, the term of this patent is extended or adjusted under 35 U.S.C. 154(b) by 421 days.

(21) Appl. No.: 12/020,147

(22) Filed: Jan. 25, 2008

(65) Prior Publication Data

US 2009/0189826 A1 Jul. 30, 2009

(51) Int. Cl.
*H01Q 3/00* (2006.01)
*H01P 1/18* (2006.01)

(52) U.S. Cl. ..... 343/757; 343/763; 333/156; 333/161

(58) Field of Classification Search ..... 343/757, 343/763, 850, 853; 333/156, 159, 161
See application file for complete search history.

(56) References Cited

U.S. PATENT DOCUMENTS

| | | | | |
|---|---|---|---|---|
| 3,005,168 | A | 10/1961 | Fye | |
| 3,593,216 | A | 7/1971 | Buck | |
| 6,850,130 | B1 | 2/2005 | Gottl et al. | |
| 6,864,837 | B2 | 3/2005 | Runyon et al. | |
| 7,170,466 | B2 * | 1/2007 | Janoschka | 343/882 |
| 7,221,239 | B2 | 5/2007 | Runyon | |
| 7,233,217 | B2 | 6/2007 | Phillips et al. | |
| 7,298,233 | B2 | 11/2007 | Zimmerman | |
| 7,301,422 | B2 | 11/2007 | Zimmerman et al. | |
| 7,589,603 | B2 * | 9/2009 | Tae et al. | 333/156 |
| 2003/0076198 | A1 | 4/2003 | Phillips et al. | |
| 2006/0164185 | A1 | 7/2006 | Tae et al. | |

FOREIGN PATENT DOCUMENTS

| | | |
|---|---|---|
| DE | 19938862 | 3/2001 |
| JP | 08051206 | 2/1996 |
| JP | 9246846 | 9/1997 |

OTHER PUBLICATIONS

Extended European Search Report related to European Appliction No. 09151229.3-2220.

* cited by examiner

*Primary Examiner* — Hoang V Nguyen
(74) *Attorney, Agent, or Firm* — Husch Blackwell LLP

(57) ABSTRACT

A phase shifter includes two or more conductive strips, an input line and a wiper coupled to both the input line and the conductive strips. Rotation of the wiper about a pivot point alters the path lengths between the input line and output ports or antenna elements connected to the conductive strips. The wiper is a multi-bladed wiper. Phase errors in multi-bladed wiper-type phase shifters are reduced. Arrangements for reduction of phase shifter size or increase in phase shift range are described.

18 Claims, 12 Drawing Sheets

PHASE SHIFTER AND ANTENNA INCLUDING PHASE SHIFTER

FIELD OF THE INVENTION

The invention relates to phase shifters, particularly but not exclusively to multi-bladed wiper-type phase shifters for use in cellular communications antennas.

BACKGROUND TO THE INVENTION

Cellular antennas often include phase shifters for adjusting the phase of signals supplied to or received from radiating elements. Adjustment of phase may be used for electronic steering of beam angle, such as electronic downtilt.

Differential phase shifters adjust the phase between a pair of signal ports. A positive phase shift is applied to one of the ports and a negative phase shift is applied to the other port.

One known type of phase shifter is the "wiper" phase shifter 100 shown schematically in FIG. 1. Signals are received by the phase shifter over an input line 11 and transmitted through the phase shifter to a number of signal ports A1, A2, A3 and A4. Signals are supplied from the ports A1, A2, A3 and A4 to radiating elements A1', A2', A3' and A4' over feedlines 12.

The input line 11 includes a central annular coupling region 14. This annular conductive region 14 couples capacitively to a conductive wiper 15 which in turn couples capacitively at each end to a conductive arc 16, 17. Thus signals received over the input line 11 are transmitted through the annular coupling region 14 and the wiper 15 to the arcs 16, 17.

The wiper 15 pivots around the point 18 at the centre of the central coupling region 14. Rotation of the wiper around this point alters the path length between the input line 11 and each of the signal ports A1, A2, A3 and A4, thereby introducing phase shifts to signals transmitted to each of those ports.

The arc 16 and the arc 17 are of different radii and are generally both centred on the pivot point 18. These different radii lead to different phase shifts for ports connected to different arcs. For example, in the phase shifter shown in FIG. 1, arc 17 has a smaller radius than arc 16. For the same angle of rotation, θ, of the wiper 15 about the pivot point 18, ports on arc 17 will experience a smaller phase shift than ports on arc 16. Thus, port A1 has a larger negative phase shift than port A2; and port A4 has a larger positive phase shift than port A3.

The Applicant has found that the configuration shown in FIG. 1 introduces undesirable phase errors.

The following is an analysis of the phases of signals supplied to each of the ports, where $R_1$ is the radius of arc 16, $R_2$ is the radius of arc 17, r is the radius of the central annular coupling region 14 and θ is the angle of the wiper 15 relative to a central position.

If we consider port A1, the phase shift includes a component created by a change in the path length in the outer arc. This component is equal to $$-\frac{2\pi R_1\theta}{\lambda}$$

where λ is the wavelength of the signals, and $R_1\theta$ is of course the length of the outer arc between the central position 20 and the point 21 where the wiper 15 intersects the arc 16.

However, the phase shift also includes a component created by a change in the path length in the central annular coupling region 14. This component is equal to $$-\frac{2\pi r\theta}{\lambda}.$$

Applying similar analysis to each port we find that:

$$\Delta\varphi(A1) = \frac{2\pi\theta}{\lambda}(-r - R_1)$$

$$\Delta\varphi(A2) = \frac{2\pi\theta}{\lambda}(r - R_2)$$

$$\Delta\varphi(A3) = \frac{2\pi\theta}{\lambda}(r + R_2)$$

$$\Delta\varphi(A4) = \frac{2\pi\theta}{\lambda}(-r + R_1)$$

From the above equations it can be seen that the phase shifts provided to the various ports are not symmetric about zero phase shift. That is, $\Delta\phi(A1)\neq-\Delta\phi(A4)$ and $\Delta\phi(A2)\neq-\Delta\phi(A3)$. Furthermore, the phase shifts introduced between all pairs of adjacent antenna elements cannot be made equal. These are undesirable phase errors which have a negative impact on the performance of an antenna including the phase shifter.

Wiper phase shifters are also generally bulky and therefore unsuitable for some applications.

It is an object of the invention to provide improved antenna performance.

It is a further object of the invention to reduce undesirable phase errors in wiper-style phase shifters.

It is another object of the invention to provide a wiper-type phase shifter with a reduced size.

EXEMPLARY EMBODIMENTS

There is provided a wiper-type phase shifter and an antenna including a wiper-type phase shifter. The antenna elements and the phase shifter are arranged in such a manner that phase errors present in prior devices are reduced. In particular, a first antenna element intended to have a greatest positive phase shift and a second antenna element intended to have a greatest negative phase shift are connected to different arcs in the phase shifter.

There is also provided a wiper-style phase shifter which is more compact than prior phase shifters and/or provides a greater phase shift than prior phase shifters of equivalent dimensions. The arcs in the phase shifter may be arranged for increased electrical length. The wiper may be arranged for increased electrical length.

In one exemplary embodiment there is provided an antenna including a plurality of antenna elements and a feed network configured to feed signals to and/or receive signals from the antenna elements, wherein the feed network includes a multi-bladed wiper-type phase shifter including:

two or more conductive strips positioned about a pivot point;

a wiper configured to pivot about the pivot point and having a first blade extending in a first direction for coupling with one or more of the conductive strips and a second blade extending in a second direction for coupling with one or more of the conductive strips; and an input line configured to couple with the wiper near the pivot point;

wherein the wiper is configured to pivot about the pivot point so as to vary the path lengths from the input line to antenna elements connected to the conductive strips;

and wherein an antenna element having a first maximum phase shift is connected to a first conductive strip and another antenna element having a second maximum phase shift opposite to the first maximum phase shift is connected to a second conductive strip.

In another exemplary embodiment there is provided a multi-bladed wiper-type phase shifter including:

two or more conductive strips positioned about a pivot point;

a wiper configured to pivot about the pivot point and having a first blade extending in a first direction for coupling with one or more of the conductive strips and a second blade extending in a second direction for coupling with one or more of the conductive strips;

an input line configured to couple with the wiper near the pivot point; and a plurality of output ports on the conductive strips for connection of antenna elements to the phase shifter, the output ports including:

a first output port on a first conductive strip providing a first maximum phase shift; and a second output port on a second conductive strip providing a second maximum phase shift opposite to the first maximum phase shift;

wherein the wiper is configured to pivot about the pivot point so as to vary the path lengths from the input line to the output ports.

In a further exemplary embodiment there is provided an antenna including a plurality of antenna elements and a feed network configured to feed signals to and/or receive signals from the antenna elements, wherein the feed network includes a multi-bladed wiper-type phase shifter including:

two or more conductive strips positioned about a pivot point;

a wiper configured to pivot about the pivot point and having a first blade extending in a first direction for coupling with one or more of the conductive strips and a second blade extending in a second direction for coupling with one or more of the conductive strips;

an input line configured to couple with the wiper near the pivot point;

wherein the wiper is configured to pivot about the pivot point so as to vary the path lengths from the input line to antenna elements connected to the conductive strips, and wherein the elements of each pair of adjacent antenna elements are connected to different conductive strips.

In another exemplary embodiment there is provided an antenna including a plurality of antenna elements and a feed network configured to feed signals to and/or receive signals from the antenna elements, wherein the feed network includes a multi-bladed wiper-type phase shifter including:

two or more conductive strips positioned about a pivot point;

A wiper configured to pivot about the pivot point and having a first blade extending in a first direction for coupling with one or more of the conductive strips and a second blade extending in a second direction for coupling with one or more of the conductive strips;

an annular central coupling region around the pivot point for coupling an input line to the wiper;

wherein the wiper is configured to pivot about the pivot point so as to vary the path lengths from the input line to antenna elements connected to the conductive strips, and wherein the phase difference between at least one pair of elements is substantially determined by a path difference created by the position of the wiper with respect to the central coupling region.

In a further exemplary embodiment there is provided a multi-bladed wiper-type phase shifter including an input line coupled to a wiper, the wiper being coupled to a plurality of conductive strips and being movable with respect to the conductive strips so as to vary the effective path lengths from the input line to output ports connected to the conductive strips, wherein at least one of the conductive strips is an increased electrical length conductive strip having an electrical length greater than the electrical length of a simple conductive strip of the same physical dimensions.

BRIEF DESCRIPTION OF THE DRAWINGS

The invention will now be described by way of example only, with reference to the accompanying drawings, in which.

DESCRIPTION OF EMBODIMENTS OF THE INVENTION

In the description below, for ease of reference, the numbers 1 to 10 following a letter (B, C etc) are used to label the signal ports of phase shifters. The ports are labelled in order of phase shift provided to the port. That is, port 1 has the highest negative (or positive) phase shift, while the highest numbered port has the highest positive (or negative) phase shift. Similarly, the antenna elements are labelled B1' to B10' etc.

Figure 1:
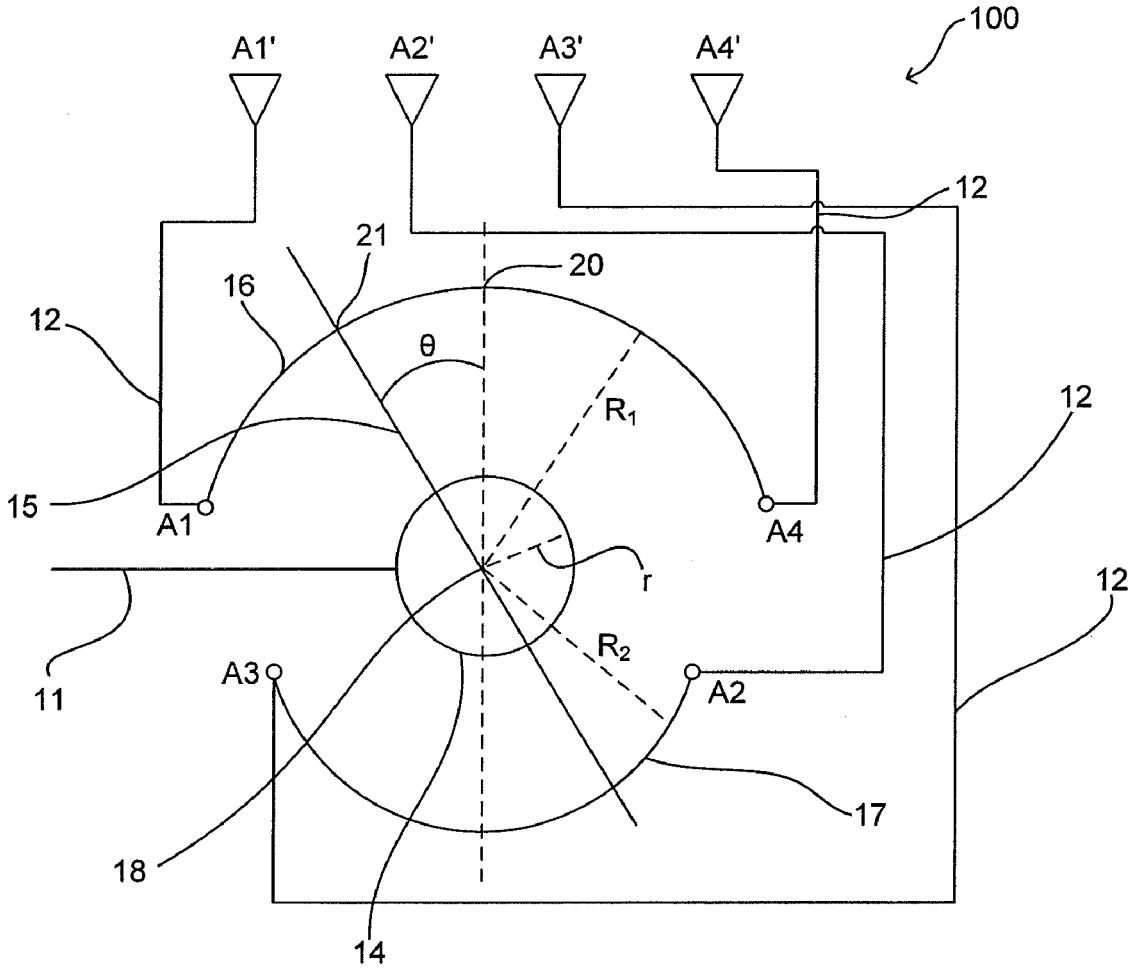
PRIOR ART Figure 1
FIG. 1 is a schematic diagram of a prior art phase shifter.
Figure 2:
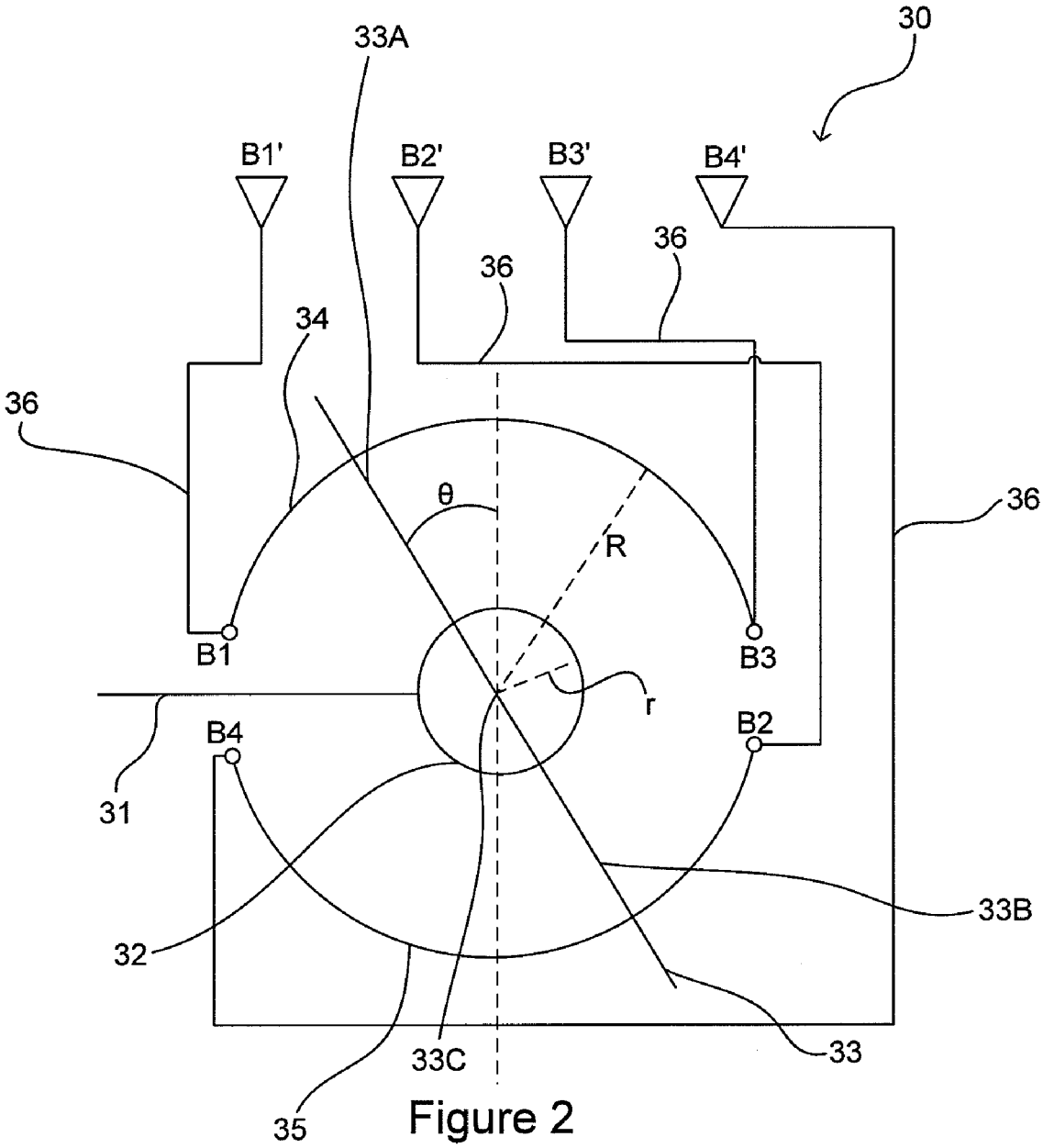
FIG. 2 is a schematic diagram of a phase shifter according to one embodiment.

FIG. 2 is a schematic diagram of an antenna 30 according to one embodiment. The antenna 30 may include a feed network for feeding signals to and/or receive signals from the antenna elements. This feed network may include a wiper-type phase shifter which receives signals via an input line 31 and supplies signals to a number of output signal ports B1, B2, B3 and B4.

The output ports may be any form of port suitable for connection of antenna elements, including simply a section of feedline to which antenna feedlines can be soldered, for example.

The input line 31 may include a central annular coupling region 32, where signals couple with a conductive wiper 33. The conductive wiper may be a multi-bladed wiper having a first blade 33A extending in a first direction and a second blade 33B extending in a second direction from the centre of the wiper. The wiper 33 may pivot around a pivot point 33C in the centre of the annular coupling region 32. Thus the input line 31 couples with the wiper 33 near the pivot point 33C.

Signals travel along the wiper blades and couple via each blade of the wiper 33 with a conductive strip. The conductive strips are positioned about the pivot point 33C and could be of any suitable form including substantially straight or curved strips of any suitable curvature. In the embodiment shown the conductive strips are in the form of arcs 34, 35. The arcs 34, 35 may be substantially circular arcs and may be centred on the pivot point 33C. This has the advantage that the distance that signals travel along the wiper from the annular coupling region to the conductive strip is constant.

At each end of each arc 34, 35 there may be connected or situated a signal port B1, B2, B3 and B4. Each signal port may be connected via a feedline 36 to an antenna element B1', B2', B3' and B4'.

In the embodiment shown antenna elements B1 and B3 are connected to the top arc 34, while antenna elements B2 and B4 are connected to the bottom arc 35. This is different to prior phase shifters in which the elements intended to undergo the greatest negative and positive phase shifts (i.e. elements 1 and 4) have been connected to the same arc.

Rotation of the wiper 33 around the pivot point results in alteration of the path lengths between the input line and each of the signal ports B1, B2, B3 and B4, thereby providing an adjustable phase shift. In the embodiment shown in FIG. 2, the arcs 34, 35 each have the same radius, R. By analysis of the contributions of the path differences in the central annular region 32 and the arcs 34, 35 to the phase shifts, we find that:

$$\Delta\varphi(B1) = \frac{2\pi\theta}{\lambda}(-r - R)$$

$$\Delta\varphi(B2) = \frac{2\pi\theta}{\lambda}(r - R)$$

$$\Delta\varphi(B3) = \frac{2\pi\theta}{\lambda}(-r + R)$$

$$\Delta\varphi(B4) = \frac{2\pi\theta}{\lambda}(r + R)$$

where R is the radius of arcs 34, 35, r is the radius of the central annular coupling region 32, θ is the angle of the wiper 33 relative to a central position and λ is the wavelength of the signals.

Here the undesirable phase errors present in the prior art have been eliminated. There is a substantially linear phase distribution across the antenna elements. Δϕ(B1)=−Δϕ(B4) and Δϕ(B2)=−Δϕ(B3). If desired, the phase difference between all pairs of adjacent elements can be made equal.

In general, the radius of the annular coupling region and the radius of the longest conductive arc may be determined as follows:

$$R = \frac{(N-1)d\sin(\beta_{max})}{4\theta_{max}\sqrt{\varepsilon_{eff}}}$$

$$r = \frac{d\sin(\beta_{max})}{4\theta_{max}\sqrt{\varepsilon_{eff}}}$$

where $\beta_{max}$ is the maximum antenna beam steering angle, d is the distance between adjacent antenna elements, $\theta_{max}$ is the maximum angle of rotation of the wiper, $\in_{eff}$ is the effective dielectric constant of the printed circuit board and N is the number of antenna elements.

Note that the use of two arcs 34, 35 of the same radius is different to the prior art in which arcs of different radius were used. In the prior art, the phase shift resulted entirely from path length changes in the arcs. In contrast the phase shift in the Applicant's device depends on path differences in the arcs and those resulting from the wiper's position with respect to the annular coupling region.

In fact, the phase difference between ports B1 and B2 and the phase difference between ports B3 and B4 is $$\frac{4\pi\theta r}{\lambda},$$

independent of the radius R of the arcs. Thus the phase difference between some ports is substantially determined by a path difference resulting from the wiper's position with respect to the annular coupling region.

In general, an antenna may have N antenna elements connected to a phase shifter. The antenna elements may be arranged in phase shift order from an element having a first maximum phase shift (either positive or negative) to an element having a second maximum phase shift (negative or positive).

The antenna elements connected to a phase shifter may be arranged in a linear array. An antenna may include more than one phase shifter, each connected to a set of antenna elements arranged in a linear array. In this case, the linear arrays together may form a two-dimensional array.

An antenna element (which may be the first antenna element in phase shift order) having a first maximum phase shift may be connected to a first conductive strip and another antenna element having a second maximum phase shift opposite to the first maximum phase shift may be connected to a second conductive strip. Thus, when the wiper is pivoted to the position shown in FIG. 2, Δϕ(B1) is negative while Δϕ(B4) is positive. However, rotation of the wiper may be to either direction of the central position, so that when the wiper is rotated clockwise Δϕ(B1) will be positive while Δϕ(B4) is negative.

A second antenna element in the phase shift order may be connected to the same conductive strip as the $N^{th}$ element while a $(N-1)^{th}$ element may be connected to the same conductive strip as the first element.

In phase shift order, each pair of adjacent antenna elements may be positioned on different conductive strips.

The output ports in the Applicant's phase shifter may be arranged to fulfill these phase conditions. Thus a first output port providing a first maximum phase shift may be positioned on a first conductive strip; and a second output port providing a second maximum phase shift opposite to the first maximum phase shift may be positioned on a second conductive strip.

Similarly, the phase difference between at least one pair of output ports is substantially determined by the position of the wiper with respect to the central coupling region. Also, output ports which are adjacent in phase order are connected to different conductive strips.

Figure 3:
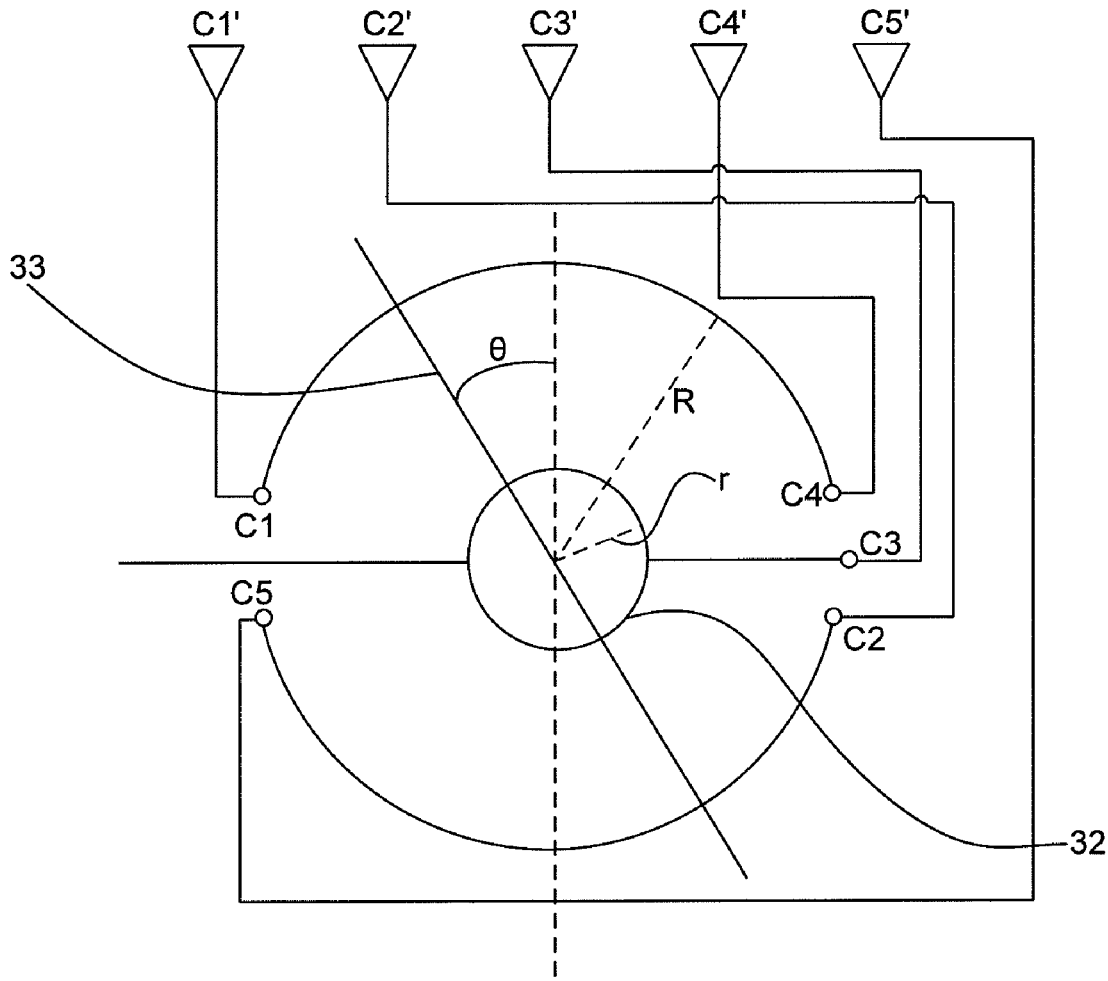
FIG. 3 is a schematic diagram of a phase shifter according to a further embodiment.

FIG. 3 is a schematic diagram of a further embodiment. This is similar to FIG. 2 except that a further signal port has been added, such that this is now a five output port phase shifter. The central port C3 is simply connected to the central coupling region 32. This means that the phase of the port C3 is independent of the wiper angle. A suitable fixed phase shift for the central port C3 may be provided. Again, the phase difference between all pairs of adjacent elements can be made equal.

Figure 4:
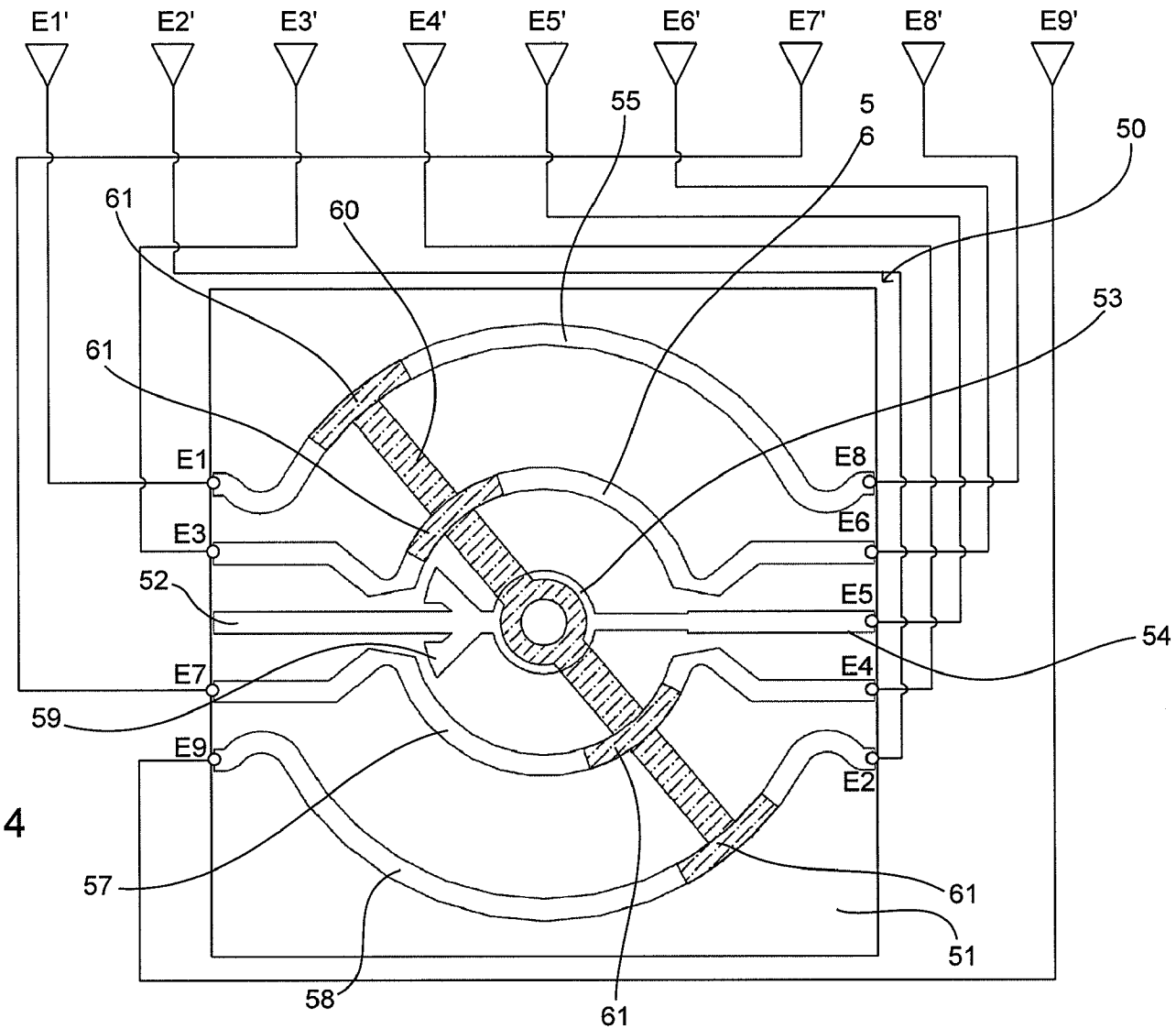
FIG. 4 shows a phase shifter according to a further embodiment.

FIG. 4 shows a further embodiment. A phase shifter 50 may be formed by creating conductive traces on a printed circuit board (PCB) 51. The conductive traces include an input line 52, central coupling region 53, central output line 54 and conductive strips in the form of conductive arcs 55, 56, 57, 58.

Two arcs 55, 56; 57, 58 are provided on each side of the central coupling region 53. The central output line is connected to a middle port E5, such that this is a nine output port phase shifter.

A matching circuit 59 may be provided on the input line 52, in order to improve impedance matching performance, as will be readily understood by the reader skilled in the art.

Figure 5:
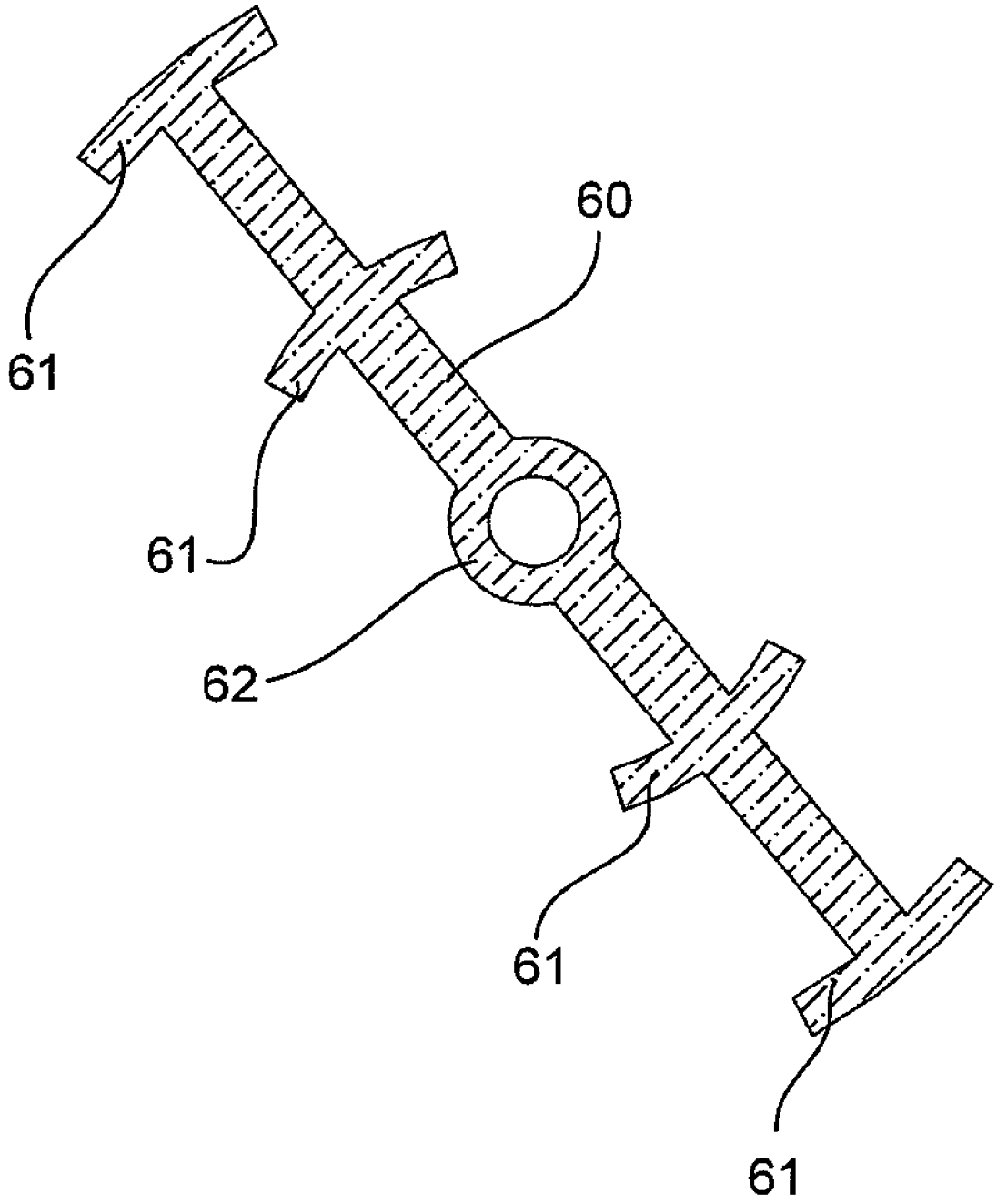
FIG. 5 shows the wiper from the phase shifter of FIG. 4.

A wiper 60 is pivotally mounted at a central pivot point and includes enlarged arcuate sections 61 for more effectively coupling to the conductive arcs 55, 56, 57, 58, as clearly shown in FIG. 5. FIG. 5 also clearly shows the wiper's annular coupling region 62 which is configured to couple to the central coupling region 53 on the PCB.

In the embodiment of FIGS. 4 and 5, the radius of the central coupling region 53 may be around $1/8^{th}$ of the radius of the outer arcs 55, 58. The radius of the inner arcs 56, 57 may be around ½ of the radius of the outer arcs 55, 58. With an appropriate fixed phase shift for element E5' this allows the phase shift between each pair of adjacent elements to be equal.

In FIG. 4 (and indeed in the embodiments of FIGS. 2 and 3) the phase shifter includes pairs of identical arcs. Arcs 55 and 58 are of the same radius; and arcs 56 and 57 are of the same radius. In this case the phase shift between some antenna elements is provided solely by the path difference in the central coupling region 53. For example, the path difference between elements E1' and E2' is $$2\frac{2\pi r\theta}{\lambda},$$

arising solely from the path difference contribution of the annular region 53. The same is true of the pairs of elements E3' and E4', E6' and E7', and E8' and E9'.

Thus the Applicant's device uses the central annular coupling region 53 to contribute to the phase shift. This is in contrast to prior devices in which the central annular region was used solely for coupling the input line to the wiper.

Note that in some embodiments no two arcs of the same radius may be included. However, even in these embodiments the central annular coupling region 53 is used to contribute to the phase shift.

In some embodiments the conductive strips may be formed for increased electrical length, that is to have an electrical length greater than a simple conductive strip of the same physical length. This increased electrical length allows for increased phase shift range for a phase shifter of particular dimensions, enabling increased electrical angle adjustment and/or a more compact phase shifter.

Figure 6:
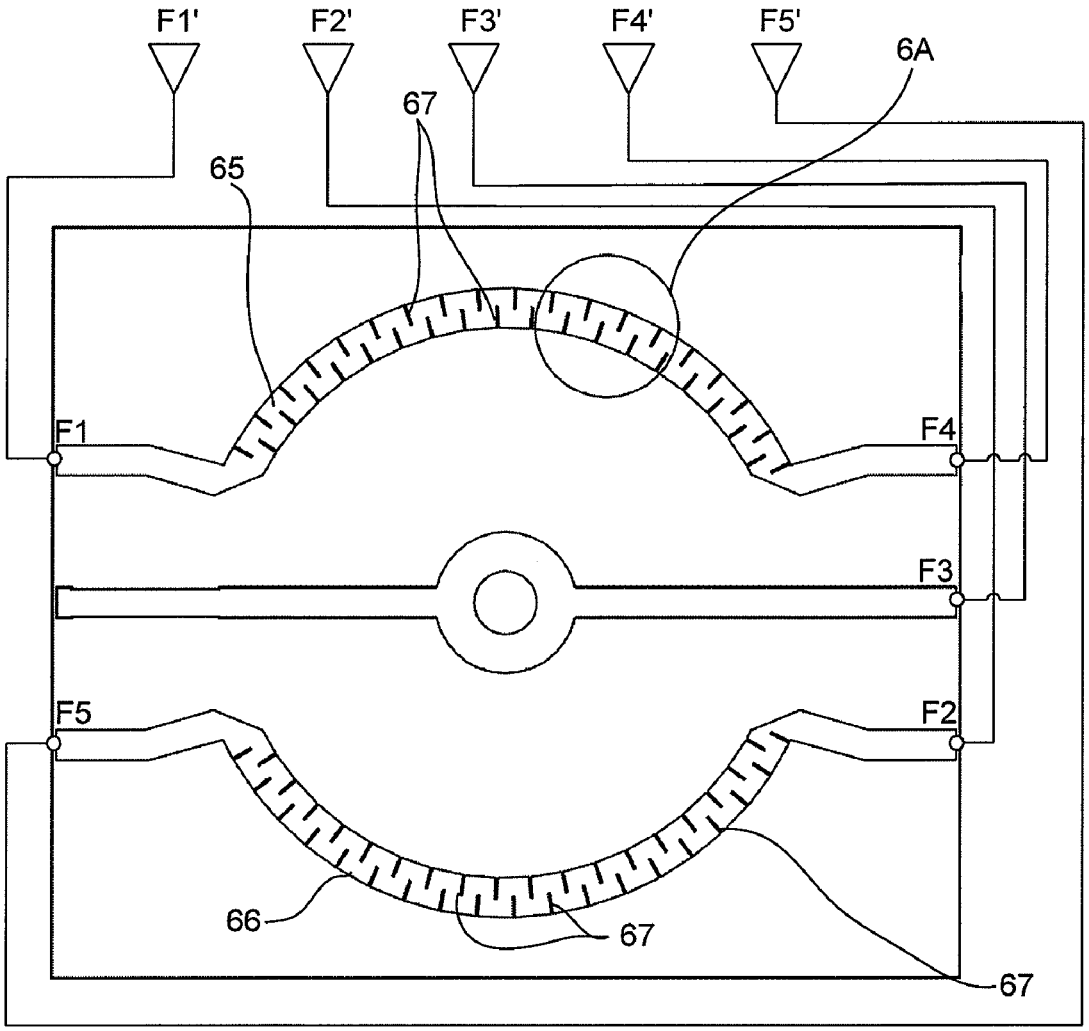
FIG. 6 shows a phase shifter according to a further embodiment.
Figure 6A:
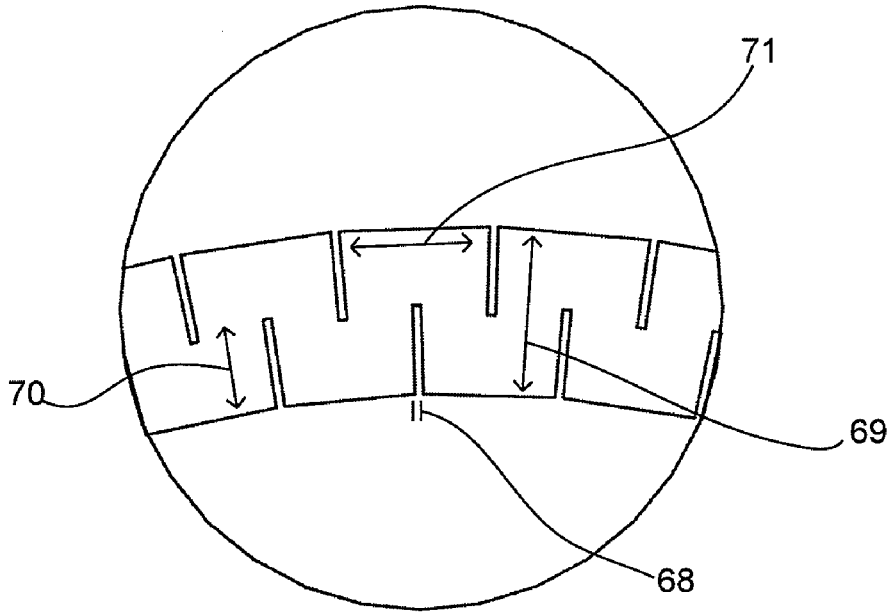
FIG. 6A is an enlarged view of part of an arc from the phase shifter of FIG. 6.

FIG. 6 shows one embodiment in which the arcs 65, 66 are formed for increased electrical length. FIG. 6A is an enlarged view of a part of a conductive arc, marked "6A" in FIG. 6.

Here each arc includes a series of notches 67 formed in both its inside and outside edges. The width 68 of the notches 67 may be less than one fifth of the width 69 of the conductive arc, preferably less than one tenth of the width 69 of the conductive arc. The length 70 of the notches 67 may be about 0.3 to 0.7 of the width 69 of the conductive arc, preferably around 0.5 of the width of the conductive arc. The spacing 71 between adjacent notches may be around 0.6 to 1.4 of the width of the conductive arc, preferably approximately equal to the width of the conductive arc.

Each notch acts as a serial inductance, and each added serial inductance increases the electrical length of the arc. Use of notches can increase the electrical length of the conductive strip by up to around 50%.

Figure 6B:
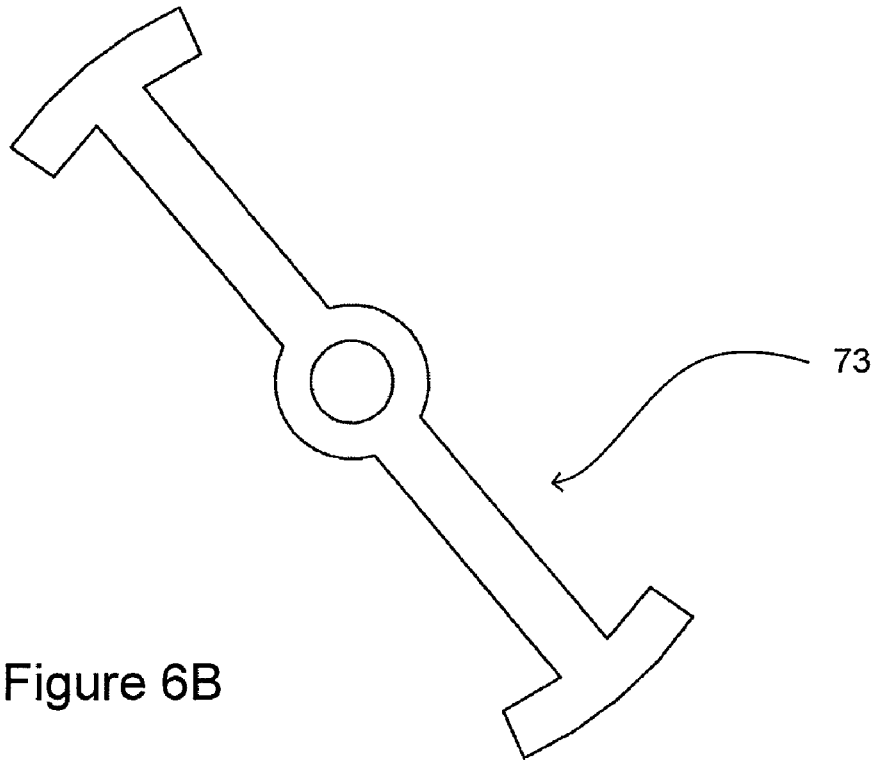
FIG. 6B shows the wiper from the phase shifter of FIG. 6.

FIG. 6B shows a suitable wiper for the phase shifter of FIG. 6.

Figure 7:
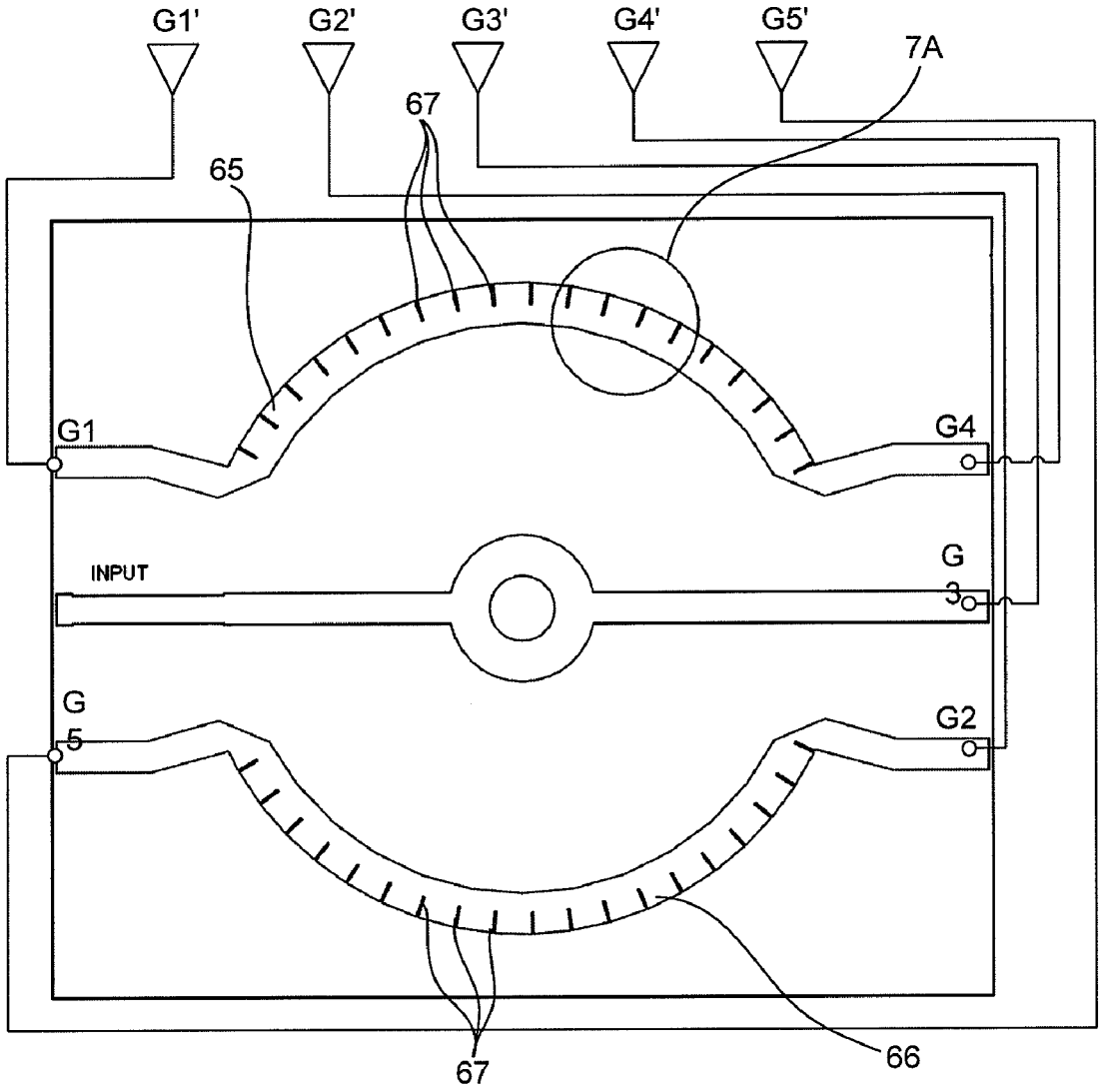
FIG. 7 shows a phase shifter according to a further embodiment.
Figure 7A:
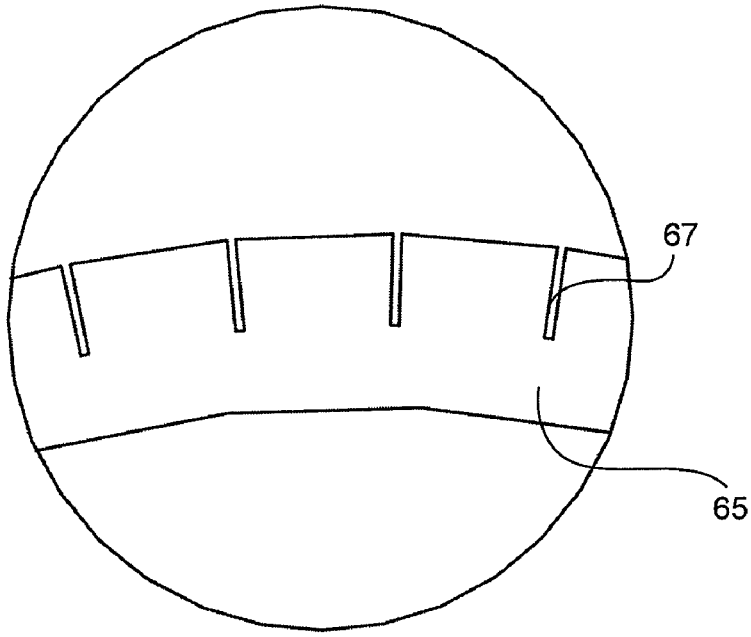
FIG. 7A is an enlarged view of part of an arc from the phase shifter of FIG. 7.

FIG. 7 shows a further embodiment in which notches are formed only in the outside edge of each arc 65, 66. FIG. 7A is an enlarged view of a part of a conductive arc, marked "7A" in FIG. 7. Thus, it can be seen that notches could be included only in the outside edge, or indeed the inside edge, of the conductive arc.

Figure 8:
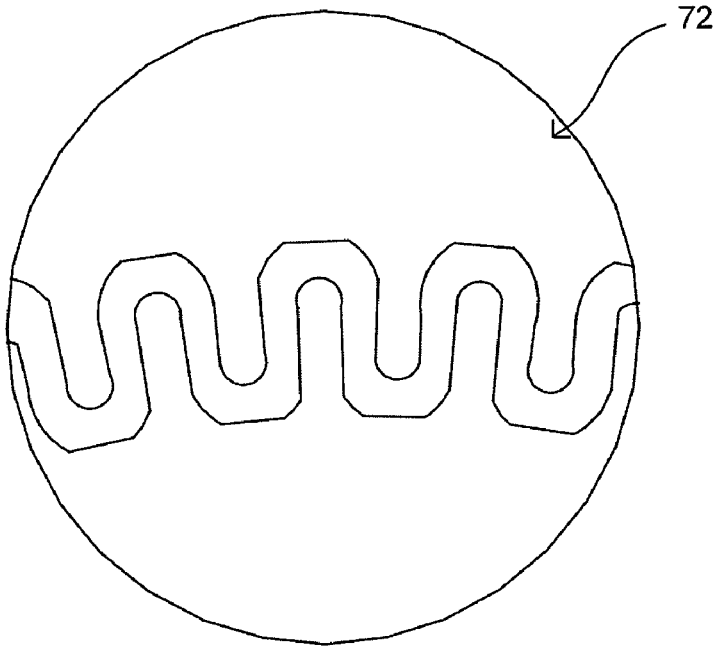
FIG. 8 illustrates a phase shifter according to a further embodiment.

FIG. 8 illustrates a further embodiment in which the physical length of the, showing a conductive arc which includes a meander section 72. The meander line is less desirable than the notched embodiment described above due to its greater bulk. However, meander lines may be suitable for some applications.

Note that the mechanism is also somewhat different, since a meander line increases the physical length of a line by including meanders. In contrast, the notched line adds a series of inductances increasing the electrical length of the line.

Figure 9:
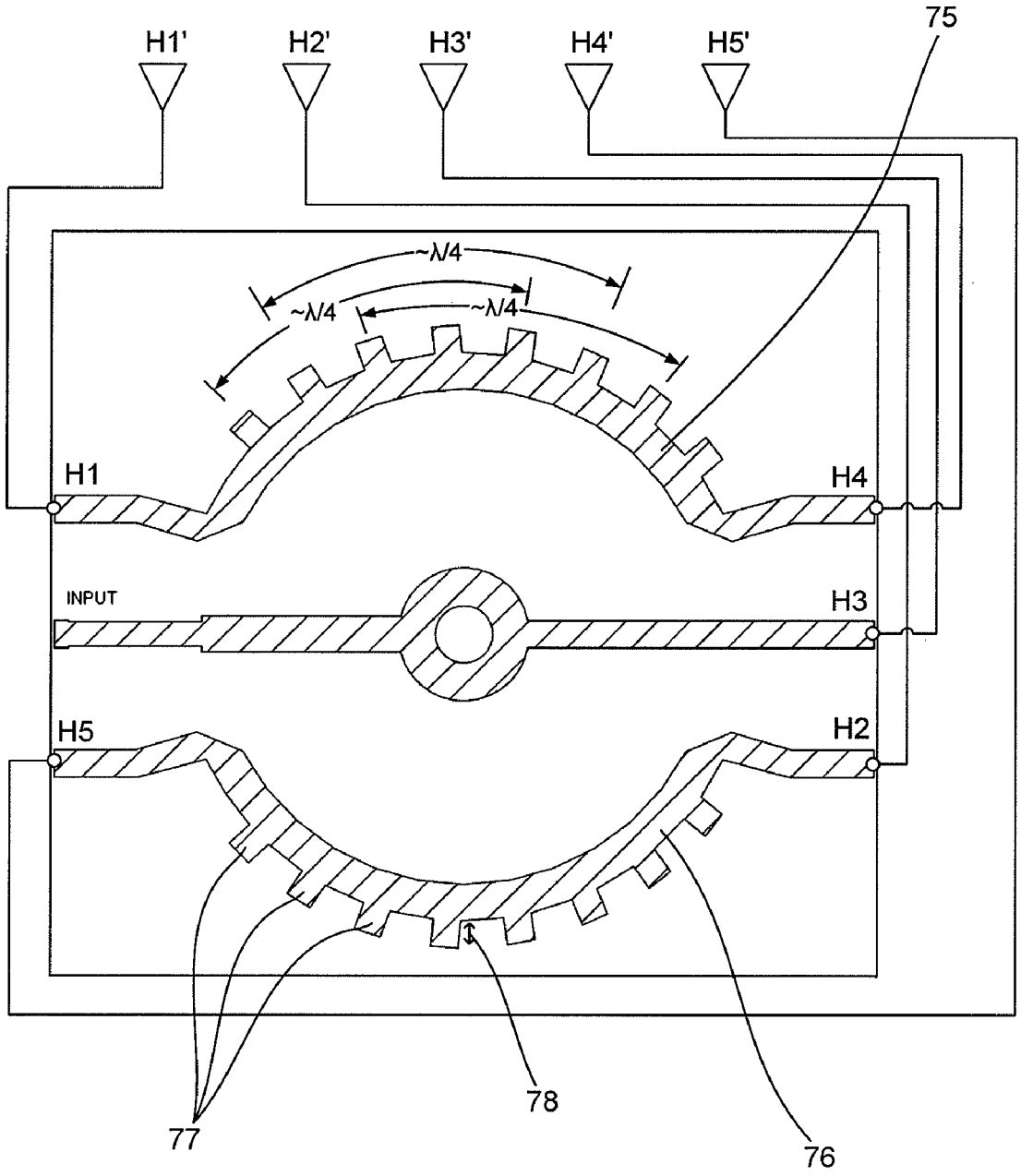
FIG. 9 shows a phase shifter according to a further embodiment.

FIG. 9 shows a further embodiment in which arcs 75, 76 are formed for increased electrical length. Each arc includes a number of open-circuit stubs 77. The length 78 of each stub is $<<\lambda/4$. Each stub has as an equivalent circuit element a capacitor connected in parallel and provides a capacitive load. This capacitive load increases the electrical length of the arc. Use of open circuit stubs can increase the electrical length of the conductive strip by up to around 50%.

In the embodiment shown in FIG. 9 the open-circuit stubs are formed in pairs separated by a path length of about $\lambda/4$. Thus, on arc 75 the first and fifth stubs, the second and sixth stubs etc may be separated by a path length of $\lambda/4$. This spacing provides good impedance matching performance, since reflections from the different open-circuit stubs cancel each other out.

Figure 9A:
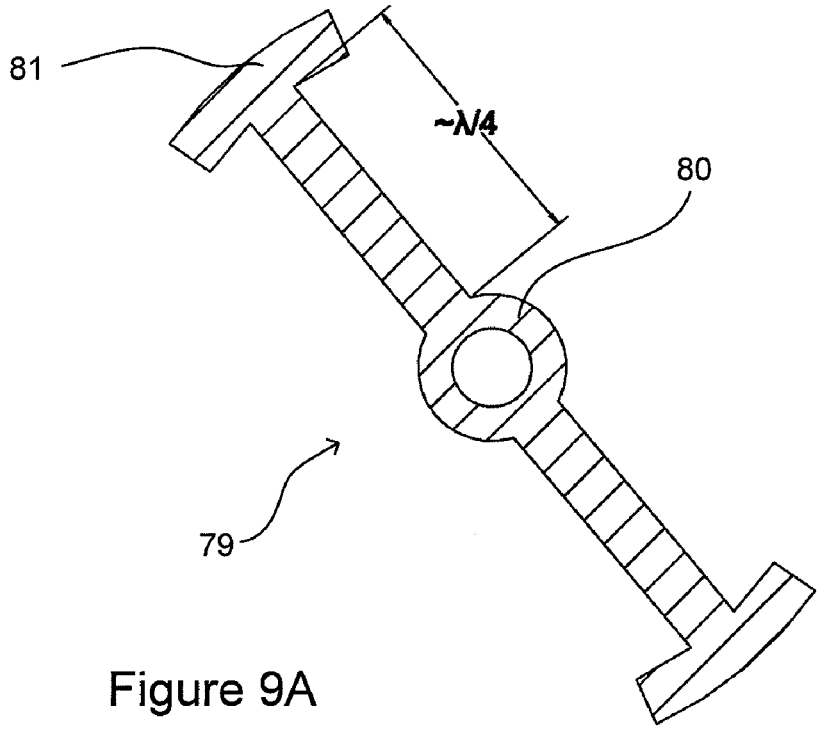
FIG. 9A shows the wiper from the phase shifter of FIG. 6.

FIG. 9A shows a suitable wiper 79 for the phase shifter of FIG. 9. The wiper 79 has a length of about $\lambda/4$ between the annular coupling region 80 and the enlarged arcuate coupling regions 81, again for impedance matching performance.

Figure 10:
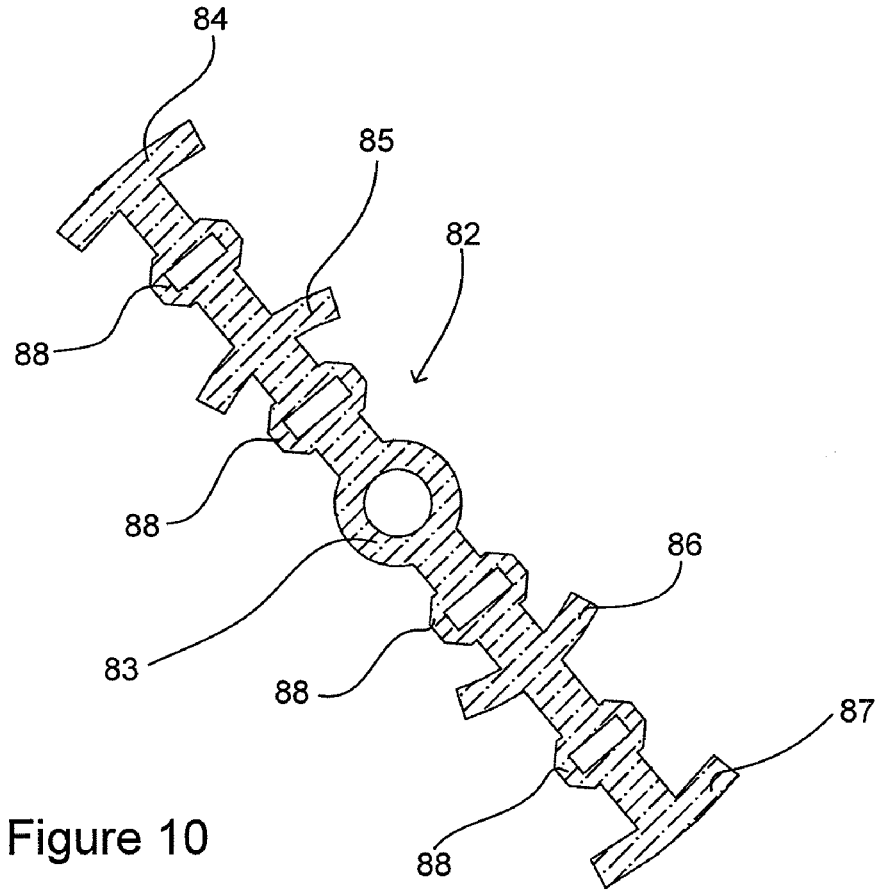
FIG. 10 shows a wiper according to a further embodiment.

FIG. 10 shows a wiper 82 suitable for a phase shifter having two arcs on each side of the central coupling region, such as that shown in FIG. 4.

The wiper 82 includes an annular coupling region 83 and an enlarged arcuate coupling region 84, 85, 86, 87 for coupling to each conductive arc. It is desirable for impedance matching performance that the electrical length between the annular coupling region and each arcuate coupling region 85, 86 should be around $\lambda/4$. Similarly the electrical length between the inner arcuate coupling regions 85, 86 and the outer arcuate coupling regions 84, 87 should be around $\lambda/4$.

In order to reduce the physical length of the wiper, a number of loop portions 88 are formed therein. Each loop includes a central space, with the conductive line passing from a first end around both sides of the space and rejoining at a second end. Each loop enables the physical size of the wiper to be decreased for the same electrical length. For example, the physical length between the coupling regions 84 and 85 may be around $\lambda/8$ to $\lambda/6$. Similarly the physical length between coupling regions 83 and 85; 83 and 86; and 86 and 87 may be around $\lambda/8$ to $\lambda/6$.

Thus the wiper blades have increased electrical lengths, i.e. the electrical length of at least a part of the wiper blade is greater than the electrical length of a simple conductive strip of the same physical length. Notched or capacitively-loaded lines similar to those described above for the conductive strips could also be used on the wiper blades for this purpose.

Figure 11:
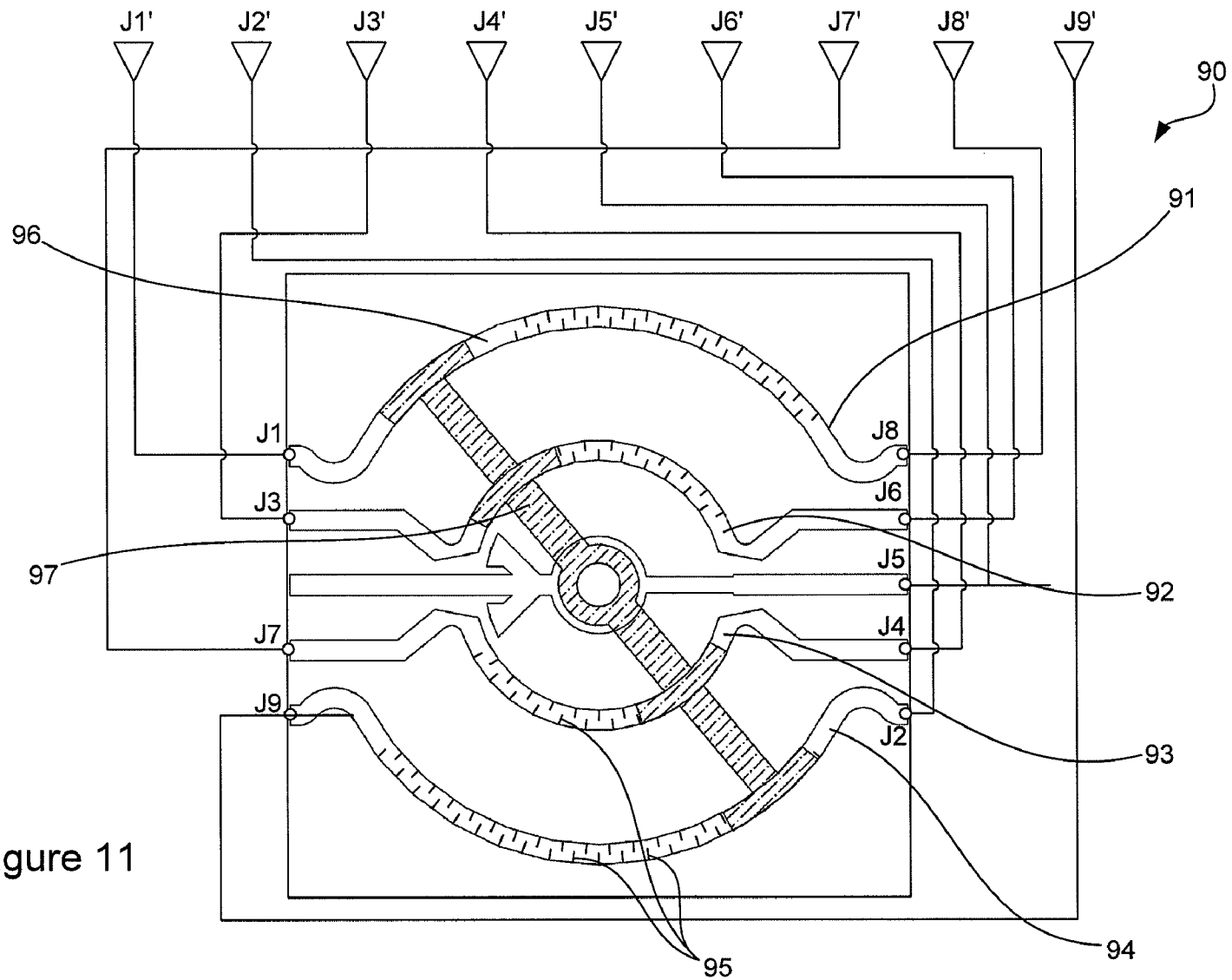
FIG. 11 shows a phase shifter according to a further embodiment, providing a non-linear phase shift.

FIG. 11 shows a further embodiment in which a non-linear phase shift is provided. The phase shifter 90 is similar to that of FIG. 5, except that all four conductive arcs 91, 92, 93, 94 include a number of notches 95 similar to those shown in FIGS. 6 and 6A. The electrical lengths of these conductive arcs are therefore greater than the electrical lengths of simple conductive strips of the same physical lengths.

However, on one conductive arc 91 the notches 95 do not extend over the full length of the arc. There is a section 96 of this arc 91 close to the output port J1 in which no notches are provided. This region is a simple conductive strip and has an electrical length less than a notched line of the same physical length.

This provides a non-linear dependence of phase shift on the wiper angle. In a base station antenna, this may be useful for sidelobe suppression at high beam tilt angles.

Upper sidelobes can cause interference between neighboring antenna sites. At high beam tilt angles more upper sidelobes contribute to this interference. Using non-linear phase shifts may assist in upper sidelobe reduction at high beam tilt angles, thereby reducing this interference.

In the embodiment of FIG. 11, the use of a linear arrangement around zero wiper angle from the central position may allow high antenna gain to be obtained for zero or small tilt angles. At these angles the upper sidelobes are directed upwards and do not contribute significantly to interference between neighboring antenna sites.

While the embodiments shown in FIGS. 2 to 11 have included the same number of conductive strips on each side of the central pivot point, other configurations can be contemplated. For example, a phase shifter could include one arc on one side of the pivot point and two arcs on the other side.

While the configurations shown include a two-bladed wiper, the wiper may be any multi-bladed wiper including a two, three or four-bladed wiper.

The antenna may be a cellular communications antenna.

The Applicant's phase shifter significantly reduces or eliminates the phase errors caused by prior wiper-type phase shifters. This allows for improved accuracy in phase and amplitude distribution between antenna elements and therefore contributes to improved antenna performance.

The reduction in phase errors leads to improved sidelobe performance. In one embodiment sidelobe levels may improve by around 3 to 5 dB. The reduction in phase errors also leads to improved null-fill performance. In one embodiment null-fill performance may improve by around 5 dB.

The antenna gain is also improved by reduction of phase errors, due to a reduction in quantization lobe levels. In one embodiment antenna gain may improve by around 0.3 dB.

Use of arcs with increased electrical length provides for increased phase shifts. This provides an increase of the range of electrical angle adjustment (such as electrical downtilt) of an antenna beam without increasing the bulk of the phase shifter. Electrical downtilt range may be doubled in some embodiments.

Alternatively, the size of the phase shifter could be reduced while still providing a desired range of angle adjustment.

While the above embodiments have been described principally with regard to transmission of signals from an input line through a phase shifter to a number of antenna elements, the phase shifter may also be used for creating phase shifts in received signals.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. An antenna including a plurality of antenna elements and a feed network configured to feed signals to and/or receive signals from the antenna elements, wherein the feed network includes a multi-bladed wiper-type phase shifter including:

i. two or more conductive strips positioned about a pivot point, at least one of the conductive strips including at least one of: meander sections and notched sections, wherein the at least one of meander sections and notched sections provides increased electrical length having an electrical length greater than the electrical length of a simple conductive strip of the same physical length;

ii. a wiper configured to pivot about the pivot point and having a first blade extending in a first direction for coupling with one or more of the conductive strips and a second blade extending in a second direction for coupling with one or more of the conductive strips; and iii. an input line configured to couple with the wiper near the pivot point;

wherein the wiper is configured to pivot about the pivot point so as to vary the path lengths from the input line to antenna elements connected to the conductive strips;

and wherein an antenna element having a first maximum phase shift is connected to a first conductive strip and another antenna element having a second maximum phase shift opposite to the first maximum phase shift is connected to a second conductive strip.

2. An antenna as claimed in claim 1 wherein the input line includes a first annular coupling region for coupling to the wiper, positioned around the pivot point.

3. An antenna as claimed in claim 2 wherein the phase difference between at least one pair of antenna elements is substantially determined by a path difference created by the position of the wiper with respect to the central coupling region.

4. An antenna as claimed in claim 2 wherein the wiper includes a second annular coupling region for coupling to the first annular coupling region.

5. An antenna as claimed in claim 1 including N antenna elements connected to the phase shifter and arranged in phase shift order from the first antenna element to the $N^{th}$ antenna element, the first antenna element being the antenna element having the first maximum phase shift and the $N^{th}$ antenna element being the antenna element having the second maximum phase shift; and wherein the first and $(N-1)^{th}$ antenna elements are connected to the first conductive strip, and the second and Nth antenna elements are connected to the second conductive strip.

6. An antenna as claimed in claim 1 wherein the elements of each pair of adjacent antenna elements are connected to different conductive strips.

7. An antenna as claimed in claim 1 wherein the wiper is a two-bladed wiper and the first and second conductive strips are positioned on opposite sides of the pivot point.

8. An antenna as claimed in claim 7 including third and fourth conductive strips positioned such that the first blade couples with the first and third conductive strips and the second blade couples with the second and fourth conductive strips.

9. An antenna as claimed in claim 1 wherein the conductive strips include one or more substantially circular arcs.

10. An antenna as claimed in claim 1 wherein the wiper includes one or more increased electrical length conductive sections having an electrical length greater than the electrical length of a simple conductive strip of the same physical dimensions.

11. An antenna as claimed in claim 1 wherein the phase shifter includes an output line connected to the input line, such that the phase of an antenna element connected to the output line is independent of the wiper angle.

12. An antenna as claimed in claim 1, being a cellular communications antenna.

13. A multi-bladed wiper-type phase shifter including:

i. two or more conductive strips positioned about a pivot point, at least one of the conductive strips including at least one of: meander sections and notched sections, wherein the at least one of meander sections and notched sections provides increased electrical length having an electrical length greater than the electrical length of a simple conductive strip of the same physical length;

ii. a wiper configured to pivot about the pivot point and having a first blade extending in a first direction for coupling with one or more of the conductive strips and a second blade extending in a second direction for coupling with one or more of the conductive strips;

iii. an input line configured to couple with the wiper near the pivot point; and iv. a plurality of output ports on the conductive strips for connection of antenna elements to the phase shifter, the output ports including:

a) a first output port on a first conductive strip providing a first maximum phase shift; and b) a second output port on a second conductive strip providing a second maximum phase shift opposite to the first maximum phase shift;

wherein the wiper is configured to pivot about the pivot point so as to vary the path lengths from the input line to the output ports.

14. A multi-bladed wiper-type phase shifter as claimed in claim 13 wherein the input line includes a first annular coupling region for coupling to the wiper, positioned around the pivot point and the phase difference between at least one pair of output ports is substantially determined by a path difference created by the position of the wiper with respect to the central coupling region.

15. A multi-bladed wiper-type phase shifter as claimed in claim 13 wherein the output ports of each pair of output ports which are adjacent in phase order are connected to different conductive strips.

16. An antenna including a plurality of antenna elements and a feed network configured to feed signals to and/or receive signals from the antenna elements, wherein the feed network includes a multi-bladed wiper-type phase shifter including:

i. two or more conductive strips positioned about a pivot point, at least one of the conductive strips including at least one of: meander sections and notched sections, wherein the at least one of meander sections and notched sections provides increased electrical length having an electrical length greater than the electrical length of a simple conductive strip of the same physical length;

ii. a wiper configured to pivot about the pivot point and having a first blade extending in a first direction for coupling with one or more of the conductive strips and a second blade extending in a second direction for coupling with one or more of the conductive strips;

iii. an input line configured to couple with the wiper near the pivot point; wherein the wiper is configured to pivot about the pivot point so as to vary the path lengths from the input line to antenna elements connected to the conductive strips, and wherein the elements of each pair of adjacent antenna elements are connected to different conductive strips.

17. An antenna including a plurality of antenna elements and a feed network configured to feed signals to and/or receive signals from the antenna elements, wherein the feed network includes a multi-bladed wiper-type phase shifter including:

i. two or more conductive strips positioned about a pivot point, at least one of the conductive strips including at least one of: meander sections and notched sections, wherein the at least one of meander sections and notched sections provides increased electrical length having an electrical length greater than the electrical length of a simple conductive strip of the same physical length;

ii. a wiper configured to pivot about the pivot point and having a first blade extending in a first direction for coupling with one or more of the conductive strips and a second blade extending in a second direction for coupling with one or more of the conductive strips;

iii. an annular central coupling region around the pivot point for coupling an input line to the wiper;

wherein the wiper is configured to pivot about the pivot point so as to vary the path lengths from the input line to antenna elements connected to the conductive strips, and wherein the phase difference between at least one pair of elements is substantially determined by a path difference created by the position of the wiper with respect to the central coupling region.

18. An antenna as claimed in claim 17 wherein a substantially linear phase distribution is provided across the antenna elements.

* * * * *